US011718994B2

(12) United States Patent
Tripod

(10) Patent No.: US 11,718,994 B2
(45) **Date of Patent: *Aug. 8, 2023**

(54) INTERLOCKING ROOFING PANEL SYSTEM AND METHOD

(71) Applicant: Englert, Inc., Perth Amboy, NJ (US)

(72) Inventor: Joseph F. Tripod, Island Heights, NJ (US)

(73) Assignee: Englert, Inc., Perth Amboy, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/835,383

(22) Filed: Jun. 8, 2022

(65) Prior Publication Data

US 2022/0298794 A1 Sep. 22, 2022

Related U.S. Application Data

(63) Continuation of application No. 17/068,464, filed on Oct. 12, 2020, now Pat. No. 11,384,543.

(51) Int. Cl.

| | |
|---|---|
| ***E04D 3/362*** | (2006.01) |
| ***E04D 3/16*** | (2006.01) |
| ***E04D 3/38*** | (2006.01) |

(52) U.S. Cl.

CPC ..... *E04D 3/362* (2013.01); *E04D 3/16* (2013.01); *E04D 3/38* (2013.01)

(58) Field of Classification Search

CPC .... E04F 13/0841; E04F 13/0842; E04D 3/16; E04D 3/361; E04D 3/362; E04D 3/365; E04D 3/38

See application file for complete search history.

(56) References Cited

U.S. PATENT DOCUMENTS

| | | | |
|---|---|---|---|
| 1,519,350 | A | 12/1924 | Belding |
| 3,269,075 | A | 8/1966 | Thomas et al. |

(Continued)

FOREIGN PATENT DOCUMENTS

| | | | |
|---|---|---|---|
| DE | 6943325 | U | 4/1970 |
| FR | 1330174 | A | 6/1963 |

(Continued)

OTHER PUBLICATIONS

Horizon Loc Installation Details Aug. 2018 downloaded from https://www.centralstatesmfg.com/wp-content/uploads/GUID_INSTL_HorizonLoc.pdf, 32 pgs.

(Continued)

*Primary Examiner* — Christine T Cajilig

(74) *Attorney, Agent, or Firm* — Fredrikson & Byron, P.A.

(57) ABSTRACT

An interlocking panel system for covering a base surface with interlocking panels to prevent water ingress is provided. A first panel includes a sheet-like section, a receptacle connected to the sheet-like section, a first projection and a second projection. An interlock includes an interlock hook portion and an interlock receiving portion with the interlock configured to be inserted into the receptacle of the first panel and at least one of the interlock hook portion or the receptacle preventing the interlock from being withdrawn from the first panel. A second panel includes a sheet-like portion and a second panel hook portion configured to be inserted into the interlock receiving portion and engage with the second projection of the first panel. At least one of the second panel hook portion or the second projection preventing the second panel from being withdrawn from the first panel and/or interlock.

20 Claims, 7 Drawing Sheets

(56) References Cited

U.S. PATENT DOCUMENTS

| | | | | | |
|---|---|---|---|---|---|
| 3,430,395 | A | * | 3/1969 | Lashkowjacki | E04F 13/0864 174/2 |
| 4,015,391 | A | * | 4/1977 | Epstein | E04F 13/0864 52/542 |
| 4,356,673 | A | * | 11/1982 | Gailey | E04F 13/0842 52/514 |
| 4,382,354 | A | | 5/1983 | Gailey et al. | |
| 4,602,469 | A | * | 7/1986 | Nuckel, Jr. | E04F 13/12 52/520 |
| 4,982,543 | A | * | 1/1991 | Boyd | E04D 3/365 52/549 |
| 5,349,801 | A | * | 9/1994 | Verbofsky | E04D 1/2918 52/545 |
| 5,519,974 | A | | 5/1996 | Greenberg | |
| 5,685,117 | A | | 11/1997 | Nicholson | |
| 6,155,006 | A | | 12/2000 | Mimura et al. | |
| 6,354,045 | B1 | | 3/2002 | Boone et al. | |
| D538,948 | S | | 3/2007 | Thimons et al. | |
| 9,605,432 | B1 | | 3/2017 | Robbins | |
| 2006/0059831 | A1 | | 3/2006 | Dombek et al. | |
| 2007/0144097 | A1 | | 6/2007 | Saarenko et al. | |
| 2010/0132275 | A1 | | 6/2010 | Stanger | |
| 2010/0186334 | A1 | | 7/2010 | Seem | |
| 2014/0250815 | A1 | | 9/2014 | Vander Laan et al. | |
| 2016/0145872 | A1 | | 5/2016 | Anderson et al. | |

FOREIGN PATENT DOCUMENTS

| | | | | | |
|---|---|---|---|---|---|
| FR | 2845710 | A1 | * | 4/2004 | E04C 2/292 |
| FR | 2845710 | B1 | | 2/2006 | |
| GB | 896611 | A | * | 5/1962 | |
| GB | 896611 | A | | 5/1962 | |
| GB | 2274291 | A | | 7/1994 | |
| WO | 8600363 | A1 | | 1/1986 | |

OTHER PUBLICATIONS

International Patent Application No. PCT/US2021/054539, International Search Report and Written Opinion dated Jan. 27, 2022, 14 pages.

* cited by examiner

INTERLOCKING ROOFING PANEL SYSTEM AND METHOD

CROSS REFERENCE TO RELATED APPLICATION

This application is a continuation application of U.S. patent application Ser. No. 17/068,464, filed Oct. 12, 2020 and titled "INTERLOCKING ROOFING PANEL SYSTEM AND METHOD." The entire content of this application is incorporated herein by reference.

TECHNICAL FIELD

This disclosure relates to roofing, and in particular, to roofing panels.

BACKGROUND

Because of their exposure to the elements, roofs are provided with weather proofing to prevent damage to the underlying interior structure. On residential buildings in particular, the roof is provided with a predetermined pitch to allow moisture to run off the roof. Secured to the roof are shingles or panels, which are overlapped in accordance with the pitch of the roof to shed moisture and/or water off the roof. A variety of materials are used for roofing shingles and panels such as, metal, wood, and petroleum-based materials. Typically, a roof will also contain a water barrier layer beneath the roof shingles and/or panels such as tar paper, to protect the roof so that the water does not enter the interior of the building.

Some metal roofing structures include, for instance, long metal panels that extend from a roof ridge all the way to the eves of a roof. These roofing panels may be connected together along their edges with standing seams or they may be attached to a roof deck with overlapping ridges along their edges.

In recent years, decorative metal roofing panels that, when assembled, resemble other traditional types of roofing have become popular. For example, decorative metal roofing panels that resemble cedar shakes, barrel shingles, or slate shingles are among the available choices for consumers. Although popular, decorative roofing panels have suffered from a variety of problems for installers and homeowners including difficult installation, susceptibility to wind and water penetration once installed, objectionable brakes in geometry, and ship lapped ends susceptible to water leakage.

In a typical roofing installation, roof shingles and/or panels are installed beginning at the lowest point of the roof and extending out over the bottom edge of the roof. The shingles are mounted in rows or courses with the side edge of each shingle proximate to the adjacent shingle. The shingles in any one row are not connected together nor are they overlapping each other, and fasteners, generally nails, are used to attach the shingles to the roof. Subsequent rows or courses of shingles generally are arranged to overlap the shingles in the immediately lower rows.

SUMMARY

In general, this disclosure relates to an interlocking panel system for covering a base surface. In some examples, the system comprises a first panel, an interlock and a second panel. The first panel can comprise a sheet-like section configured to cover a portion of a planar base surface with the sheet-like section having an outer face configured to face away from the planar base surface and an inner face configured to face toward the planar base surface. The first panel can also comprise a receptacle located at an end of the first panel with the sheet-like section connected to and extending away from the receptacle. The receptacle can have an opening proximate the inner face. The first panel can also comprise a first projection extending toward the inner face and a second projection extending away from the inner face. The system can also include an interlock with an interlock hook portion and an interlock receiving portion. The interlock hook portion can be configured to be inserted into the receptacle of the first panel with at least one of the interlock hook portion or the receptacle preventing the interlock from being withdrawn from the first panel. The system can also a second panel comprising a second panel hook portion located at an end of the second panel. The second panel can also comprise a sheet-like section configured to cover a portion of the planar base surface with the sheet-like section connected to and extending away from the second panel hook portion. The second panel hook portion can be configured to be inserted into the interlock receiving portion between the first panel and the interlock. The second panel hook portion can engage with the second projection during insertion with at least one of the second panel hook portion or the second projection deflecting during the engagement therebetween. At least one of the second panel hook portion or the second projection can prevent the second panel from being withdrawn from the interlock receiving portion.

This disclosure also includes a method of installing an interlocking panel system for covering a planar base surface. In some example, the method can include securing a first panel to the planar base surface. The first panel can comprise a sheet-like section configured to cover a portion of the planar base surface with the sheet like section having an outer face configured to face away from the planar base surface and an inner face configured to face toward the planar base surface. The first panel can further include a receptacle located at an end of the first panel with the sheet-like section connected to and extending away from the receptacle. The receptacle can have an opening proximate the inner face. The first panel can further comprise a first projection extending toward the inner face and a second projection extending away from the inner face. The method can further include securing an interlock to the first panel by inserting an interlock hook portion into the receptacle of the first panel such that the interlock hook portion engages the first projection. At least one of the interlock hook portion or the first projection can prevent the interlock from being withdrawn from the first panel. The method can also include securing the interlock to the planar base surface with the interlock comprising an interlock receiving portion. The method further includes securing a second panel to the first panel by inserting a second panel hook portion into the interlock receiving portion between the first panel and the interlock such that the second panel hook portion engages the second projection and at least one of the second panel hook portion or the second projection deflect during the engagement therebetween. The at least one of the second panel hook portion or the second projection preventing the second panel from being withdrawn from the interlock receiving portion.

This disclosure also includes an interlocking panel system for covering a planar base surface. The system can include a first panel comprising a receptacle located at an end of the first panel and a planar section configured to cover a portion of the planar base surface. The planar section can be connected to and extend away from the receptacle and can comprise an inner face facing toward the planar base surface and an outer face facing away from the planar base surface. The first panel can also comprise a first projection facing the inner surface and a second projection facing the planar base surface. The system can further include an interlock comprising a hook portion and a receiving portion with the hook portion configured to be inserted into the receptacle of the first panel. At least one of the hook portion or the receptacle can prevent the interlock from being withdrawn from the first panel. The system can also include a second panel comprising a hook portion located at an end of the second panel and a planar section configured to cover a portion of the planar base surface with the planar section connected to and extending away from the hook portion. The hook portion can be configured to be inserted into the receiving portion between the first panel and the interlock with the hook portion engaging with the second projection during insertion. At least one of the hook portion or the second projection can deflect during the engagement therebetween with at least one of the hook portion or the second projection preventing the second panel from being withdrawn from the first panel.

DETAILED DESCRIPTION

The following detailed description is exemplary in nature and is not intended to limit the scope, applicability, or configuration of the invention in any way. Rather, the following description provides some practical illustrations for implementing embodiments of the present invention. Examples of constructions, materials, and/or dimensions are provided for selected elements. Those skilled in the art will recognize that many of the noted examples have a variety of suitable alternatives.

Figure 1:
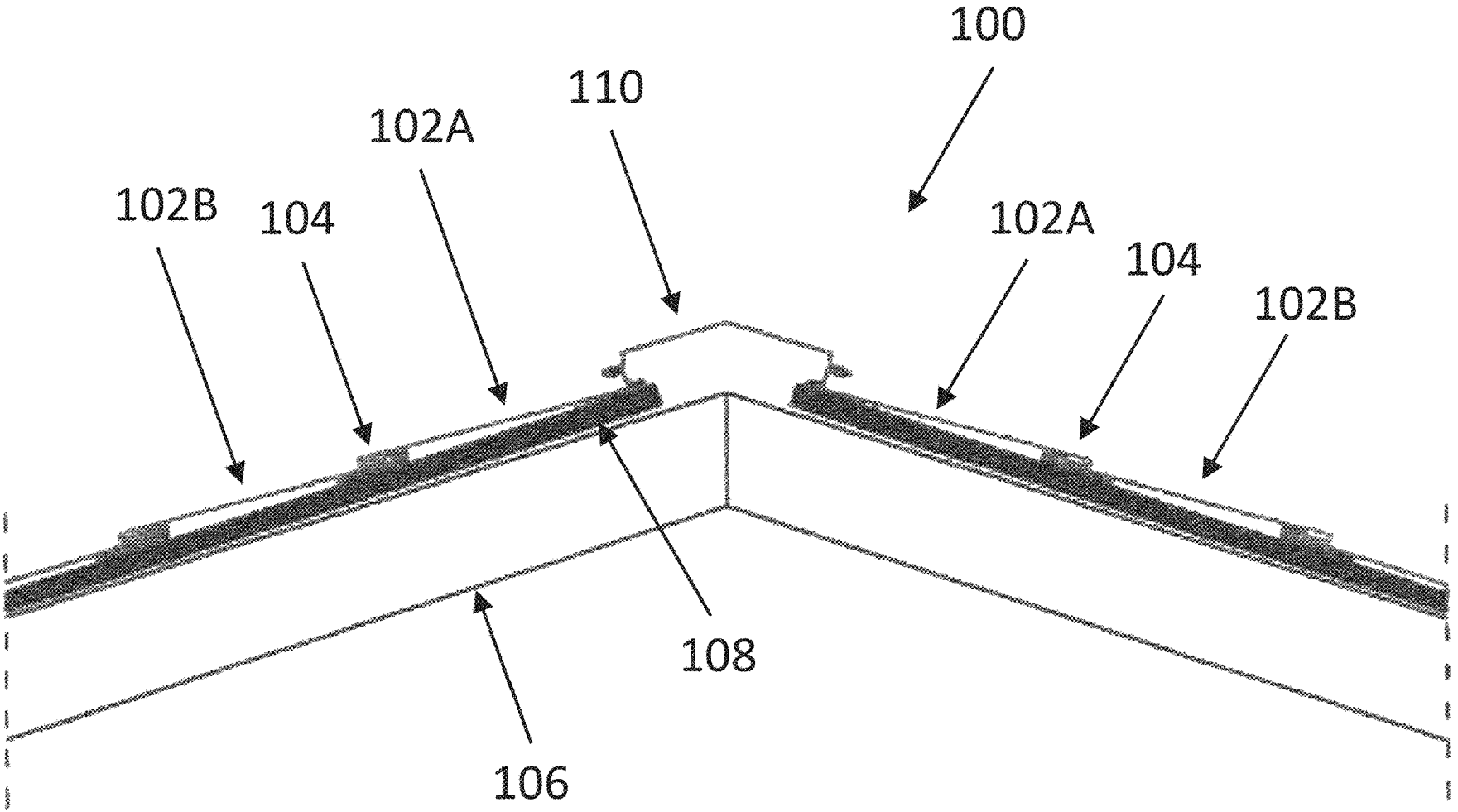
FIG. 1 is a cross-sectional view of an example sloped roof with a number of roofing panels according to an aspect of the present disclosure.

FIG. 1 is a cross-sectional view of an example roof 100 including panels 102A, 102B and couplings 104. The roof 100 includes a support structure 106 and a base surface 108. Base surface 108 is coupled to the support structure 106 and can provide a generally planar surface which can slope downward from a peak of the roof 110. In some examples, the base surface 108 is a planar base surface. The slope (e.g. pitch) of the roof can be substantially horizontal, substantially vertical, or any slope therebetween. In some examples, the slope is a minimum of 3/12 pitch. In some examples panels 102A, 102B have a similar slope as the base surface, while in some examples, panels 102A, 102B have a different slope than the base surface. The roof can have a lower portion and an upper portion with the upper portion proximate to the peak of the roof 110 and the lower portion proximate an eave of a roof. In some examples, base surface 108 can include multiple layers of material. In some such examples, base surface 108 can include a first layer of wood (e.g. oriented strand board) coupled to a support structure 106 with further layers on top of the first layer of wood. In some examples, the layers can include, insulation, tar paper, a vapor barrier, felt underlayment, nailing planks, a drip edge, and sheathing. One having skill in the art will understand that other layers can be used for base surface 108 and that any combination of layers can be used in any order.

Continuing with the example of FIG. 1, panels 102A, 102B are configured to cover a portion of base surface 108. Panels 102A, 102B are secured to each other by couplings 104 that provide interconnection between at least two panels 102A, 102B. Panels 102A, 102B can be further secured to the base surface 108 by fasteners (e.g. nails) and/or by couplings 104. Panels 102A, 102B and couplings 104 can be made from a rigid material such as metal, which can include aluminum, steel, or other alloys, or can be made from other materials such as plastics or wood. In some examples, panels 102A, 102B are made from a combination of materials. One example advantage of using metal for panels 102A, 102B is that metal can provide a more durable roof surface and can better withstand strong winds and other weather events, especially when compared to traditional asphalt shingles. In some examples, panels 102A, 102B can have a textured surface. The textured surface can have many designs and, in some examples, can make the panels 102A, 102B appear to resemble traditional shingles. In some examples, each of panels 102A, 102B can be made from a single sheet of rigid material which can extend laterally across an entire roof, from a first edge to a second edge. In some examples, the first edge is a horizontal edge of a roof and the second edge is the other horizontal edge of the roof. Using a single sheet of material which extends laterally across the roof can be advantageous as it can reduce the number of seams between panels. Reducing the number of seams can reduce the number of points of ingress for moisture, which can further protect the base surface 108 and the rest of a building from water damage. Additionally, reducing the number of seams can reduce the number of couplings 104 needed, which can allow for easier and faster installation of the panels 102A, 102B.

In the example of FIG. 1, panels 102A, proximate to the peak of the roof 110, are coupled to the peak of the roof 110. In some examples, panels 102A are directly coupled to the peak of the roof by fasteners. The peak of roof 110 can be a ridge cap which, like the panels, can be made of metal and resist water. In some examples, couplings 104 and the coupling between the peak of roof 110 and panels 102A, are designed to resist water from penetrating the coupling, thereby preventing the exposure of the base surface 108 to water. This can have the benefit of preventing water from leaking through the roof 100. In some examples, the peak of the roof can be flat and, in some examples, panels 102A can be coupled together to form a peak of the roof.

Figure 2:
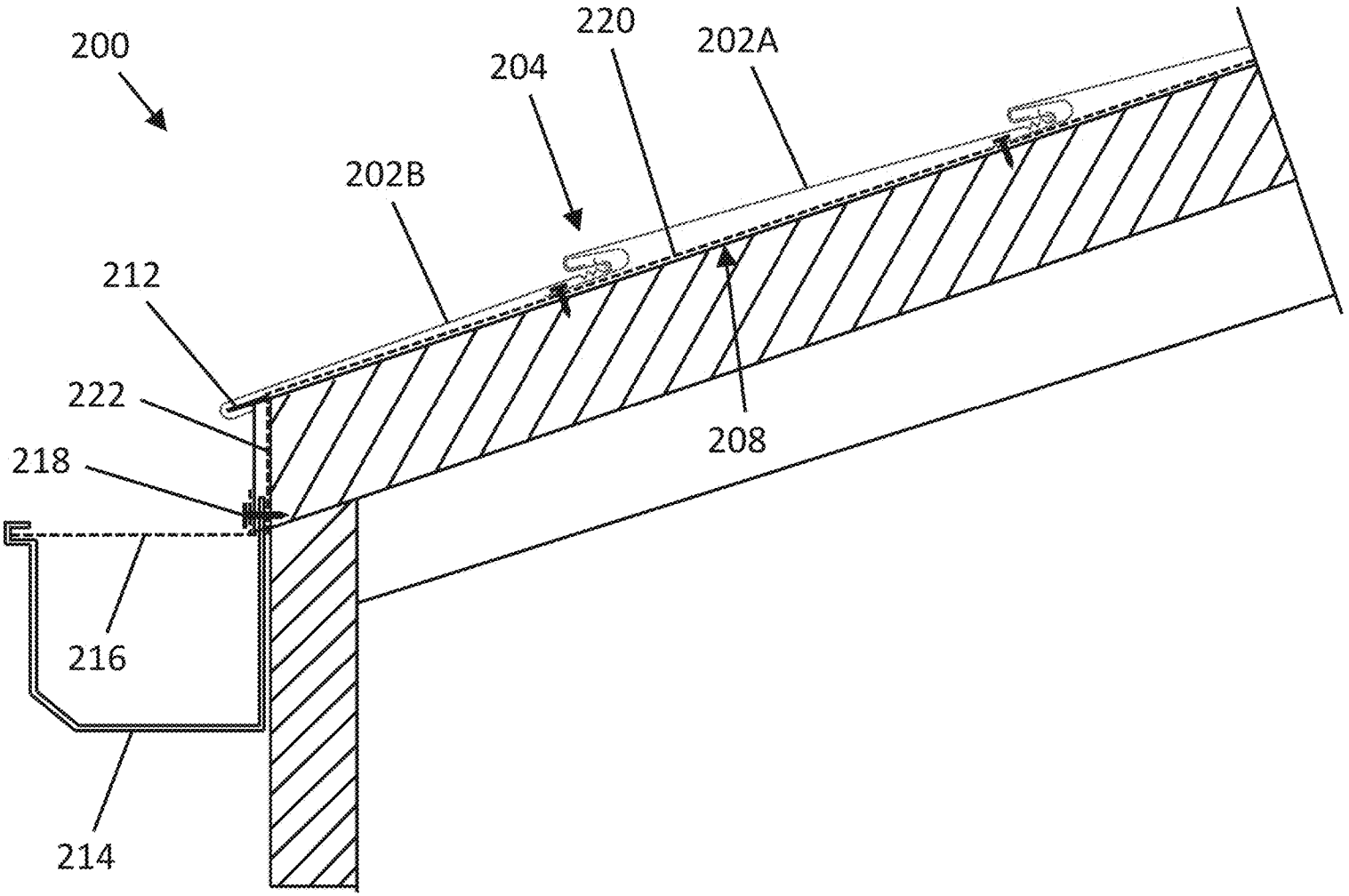
FIG. 2 is a cross-sectional view of an example sloped roof with a first panel and a second panel coupled to a base surface and secured to each other via coupling according to an aspect of the present disclosure.

Moving to FIG. 2, FIG. 2 is a cross-sectional view of an example sloped roof 200 with a first panel 202A and a second panel 202B coupled to a base surface 208 and secured to each other via coupling 204. In FIG. 2, second panel 202B extends downward from the first panel 202A to an eave trim 212 of the roof 200. In FIG. 2, the downward edge of the second panel 202B can wrap around the eave trim 212. By wrapping the downward edge of the second panel 202B around the eave trim 212, moisture can be prevented from traveling up under the second panel 202B or any panel located proximate to the eave trim 212. In some examples, eave trim 212 can include a drip edge. In other examples the eave trim can have an integrated drip edge. A drip edge can help prevent water from getting under a panel. FIG. 2 further includes a gutter 214 supported by a gutter hanger 216 coupled to the roof 200 via a fastener 218. The gutter 214 can transport water away from the roof 200 and from the house the roof sits atop.

FIG. 2 also includes an underlayment 220 which is located above the base surface 208 and below the panels 204A, 204B. The underlayment 220 can wrap over the bottom edge of the roof to a point on the side of the building as shown by 222. The underlayment 220 can be made of a material that is resistant to water and in some examples, resistant to high temperatures (e.g. 240° F.). In some examples, the underlayment 220 can be self-adhering to the base surface 208, with one example being the Englert® Metalman HT underlayment. The underlayment 220 can be a secondary barrier for preventing water from damaging the base surface 208 due to being under the panels and its water resistance.

Continuing with the example of FIG. 2, coupling 204 includes a receptacle of the first panel 204A, an interlock, and a hook portion of the second panel 204B. The receptacle is located proximate to the downward edge of the first panel 202A, the hook portion is located proximate to the upward edge of the second panel 202B, and the interlock is located proximate to the receptacle and the hook portion as is described further herein. The coupling 204 further includes a sealant located between the receptacle portion and the hook portion as described further herein. The sealant can be any water-resistant material (e.g. butyl) and can prevent water from entering the coupling 204 between the first panel 204A and the second panel 204B. The sealant can be located anywhere within coupling 204 such that it can prevent water from entering the coupling. The sealant can be pre-applied or alternatively the sealant can be applied at any stage when securing the first panel and the second panel.

Figure 3A:
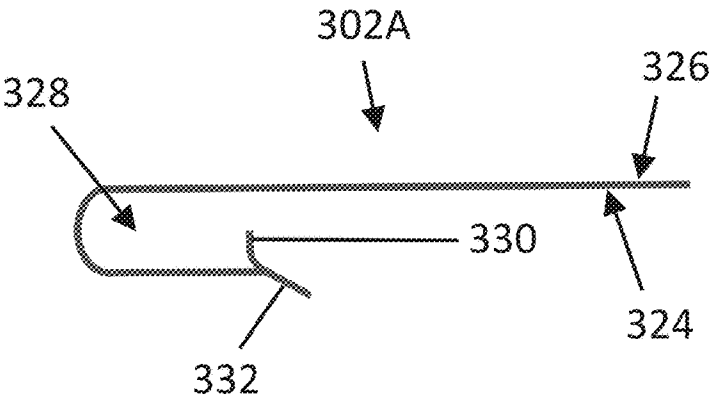
FIG. 3A is a cross-sectional view of an example part of the coupling of FIG. 2 according to an aspect of the present disclosure.
Figure 3C:
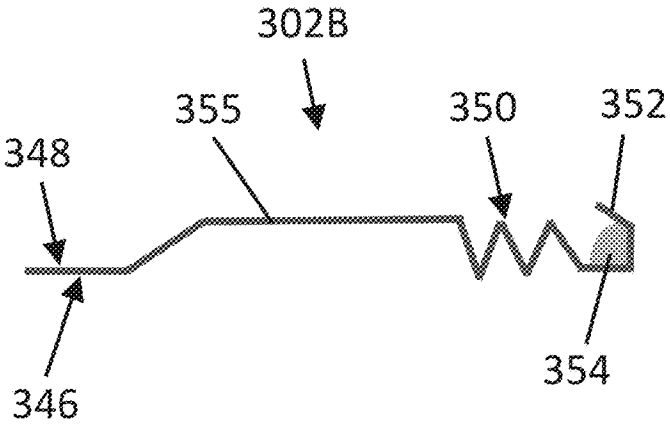
FIG. 3C is a cross-sectional view of another example part of the coupling of FIG. 2 according to an aspect of the present disclosure.
Figure 3B:
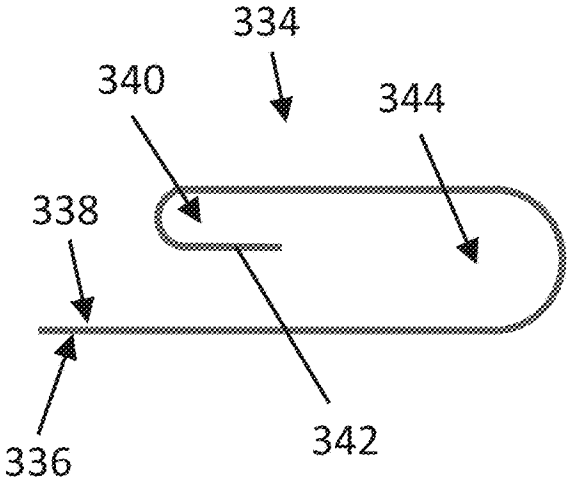
FIG. 3B is a cross-sectional view of another example part of the coupling of FIG. 2 according to an aspect of the present disclosure.

Moving to FIG. 3A-3C, FIG. 3A-3C enlarged cross-sectional views of example parts of the coupling of FIG. 2. In FIG. 3A, a first panel 302A includes a sheet-like (e.g. planar) section which has an inner face 324, which faces a base surface, and an outer face 326, opposite the inward face, which faces away from the base surface. An end portion of the first panel 302A is folded such that the outward face 326 of the first panel 302A faces toward the base surface, thereby defining receptacle 328 having an opening proximate to the inner face. The receptacle 328 is located at an end of the first panel 302A and is connected to the sheet-like portion of the first panel 302A which extends away from the receptacle. The first panel 302A also includes a first end and a second end with an opening defined by the receptacle 328 facing toward the second end of the first panel 302A. The first panel further includes a first projection 330 and a second projection 332. The first projection 330 is located proximate to an end of the first panel 302A and extends upward away from the base surface. The second projection 332 is located proximate to the end of the first panel 302A and extends away from receptacle 328.

In the example of FIG. 3B, an interlock 334 includes an inner face 336, which faces a base surface, and an outer face 338, opposite the inward face 336, which faces away from the base surface. An end portion of the interlock 334 is folded such that the outer face of the interlock 334 faces toward the base surface, thereby defining a receptacle 340. Receptacle 340, in some examples, can be considered a second receptacle while receptacle 328 can be considered a first receptacle. The interlock 334 further includes a hook portion 342 which can be an interlock hook portion and a receiving portion 344 which can be an interlock receiving portion. The interlock hook portion can terminate in an end which in some examples can be folded. The interlock receiving portion can form an opening. In some examples, the interlock opening and the end of the interlock hook portion face each other.

In the example of FIG. 3C, a second panel 302B includes a sheet-like section which has an inner face 346, which faces a base surface, and an outer face 348, which faces away from the base surface. The second panel 302B further includes a folded portion 350 which is defined by the folding of the second panel into alternating peaks and troughs. The second panel 302 further includes a hook portion 352, which can be a second panel hook portion, proximate an end of the second panel 302 which extends away from the base surface. The sheet-like section of the second panel 302B is connected to and extends away from the hook portion 352. The sheet-like section of the second panel 302B can include a raised section 355 which extends away from the folded portion 350, however in some examples, no raised section is included.

Folded portion 350 is located proximate hook portion 352. A sealant 354 is also located proximate to hook portion 352.

Figure 4:
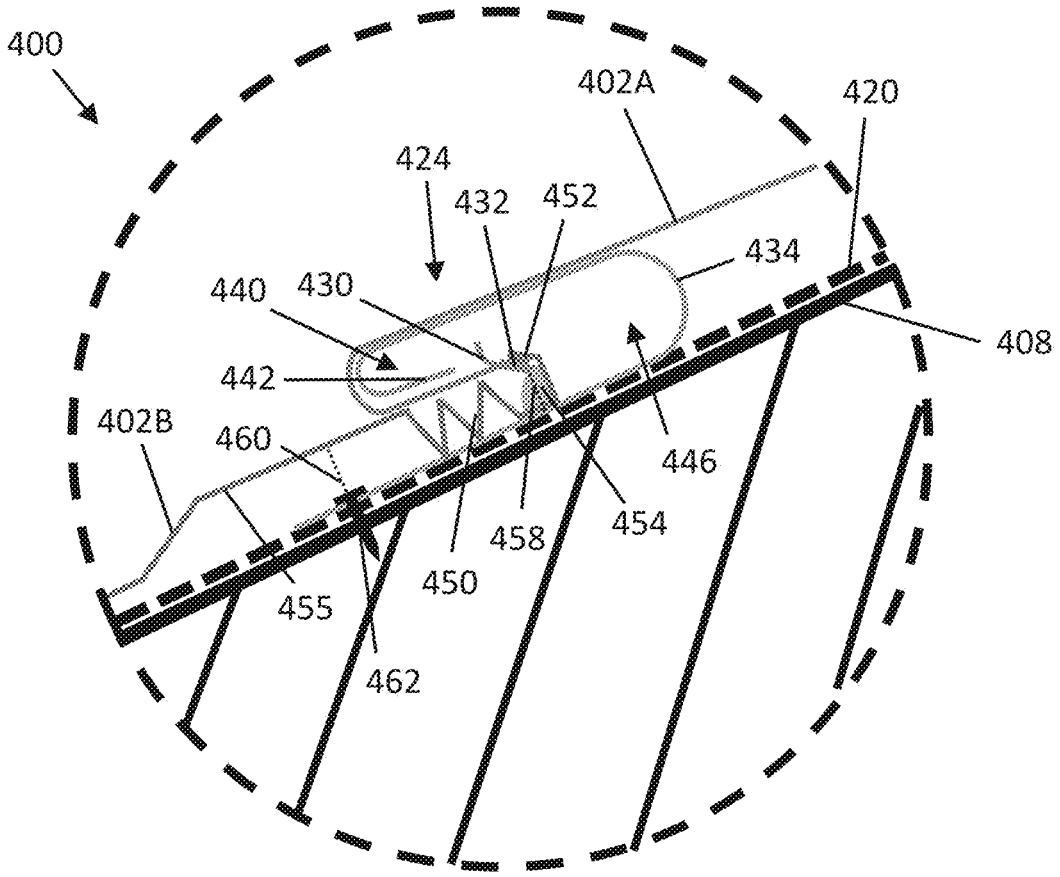
FIG. 4 is an enlarged, cross-sectional view of an example installed coupling between a first panel and a second panel according to an aspect of the present disclosure.

Moving to FIG. 4, FIG. 4 is an enlarged, cross-sectional view of an example installed coupling 400. Coupling 400 includes first panel 402A, second panel 402B, and interlock 434. First panel 402A includes a receptacle 424, a first protrusion 430, and a second protrusion 432. Line 458 extends from first panel 402A toward second panel 402B and interlock 434, defining a receiving portion 446. Second panel 402B includes a folded portion 450, a hook portion 452, and a sealant 454. Second panel 402B further includes a space 460 above fastener 462. Interlock 434 includes a receptacle portion 440, a hook portion 442, and a receiving portion 446. FIG. 4 further includes a base surface 408 and an underlayment 420.

In an example installed operation, as shown in FIG. 4, first panel 402A and second panel 402B are connected to each other. Additionally, first panel 402A is secured to the base surface. The second protrusion 432 of the first panel 402A extends at an angle toward second panel 402B and toward base surface 408. The hook portion 452 of the second panel 402B is engaged with the second protrusion 432 of the first panel 402A with the hook portion 452 being located above the second protrusion 432 relative to the base surface 408. In this configuration, the second panel 402B resists downward movement toward an eave of the roof and is supported by first panel 402A. Sealant 454, which can be any sealant, is located proximate hook portion 452 of second panel 402B and further engages the second protrusion 432 of first panel 402A. In some examples, sealant 454 can provide further support to retain second panel 402B to first panel 402A. In some examples, sealant 454 can provide a water-resistant barrier such that water cannot penetrate between first panel 402A and second panel 402B. Further, in some examples, folded portion 450 of second panel 402B can provide a water-resistant barrier. In some such examples, water, which can flow upward on the first panel 402A toward second protrusion 432 due to capillary action, can adhere to the folded portion 450 and be directed away toward the eaves of the roof. In some examples, folded portion 450 of second panel 402B can be in contact with the first panel 402A. In the example of FIG. 4, folded portion 450 can also provide a space 460 between second panel 402B and interlock 434. This can be advantageous as the space can prevent fastener 462 from touching and/or rubbing against second panel 402 which could cause damage to the second panel 402. In some examples, second panel 402B can contract and expand with heat and space 460 can ensure that little to no wearing occurs between fastener 462 and second panel 402B. Further, in some examples, folded portion 450 can lift the first panel 402A and can further support the first panel 402A such that the receptacle 424 of the first panel 402A is not in contact with the base surface 408, thereby providing a lifted section via its peaks. In some examples, a raised portion 455 lifts the first panel and can further support the first panel such that the receptacle 424 of the first panel is not in contact with the base surface, thereby providing a lifted section. In some examples, folded portion 450 can lead into raised portion 455 of second panel 402B while is some examples, the folded portion leads directly to the sheet-like portion of the second panel without raised portion 455.

Continuing with FIG. 4, interlock 434 secures first panel 402A and second panel 402B to base surface 408 using fastener 462. When installed, the receptacle portion 440 and hook portion 442 of interlock 434 are situated within the receptacle portion 424 of the first panel 402A. In some examples, receptacle 440 of interlock 434 is in direct contact with the receptacle portion 424 of the first panel 402A such that the first panel 402A and the interlock 434 are in frictional connection with each other. In the example of FIG. 4, the first protrusion 430 protrudes upwards, away from the base surface 408, such that it can prevent the hook portion 442 of the interlock from moving toward a peak of the roof, thereby preventing the interlock from moving toward the peak of the roof. In some examples, the hook portion 442 can be in contact with the first protrusion 430 such that the first panel 402A is prevented from being pulled downward to the eave of the roof due to interlock 434 being secured to the base surface 408 with fastener 462. In some examples, the interlock 434 can be made of a thicker and/or stronger material than the first panel 402A such that the interlock can provide support to the first panel 402A. Further in the example of FIG. 4, the hook portion 452 of the second panel 402B is located within the receiving portion 446 of interlock 434. In this configuration, the first panel 402A and the second panel 402B cover the interlock 434 completely such that no part of it is exposed to the exterior of the roof. This configuration can be advantageous as the connection is hidden from view which can be aesthetically pleasing. Additionally, fastener 462 is completely covered by second panel 402B and is not exposed to water or other elements which could cause the fastener to rust or otherwise degrade. Furthermore, this configuration can be advantageous as water or other possibly damaging elements can be prevented from entering the coupling 400 (e.g. through a fastener hole), thereby protecting the coupling and the underlying base surface 408.

Figure 5A:
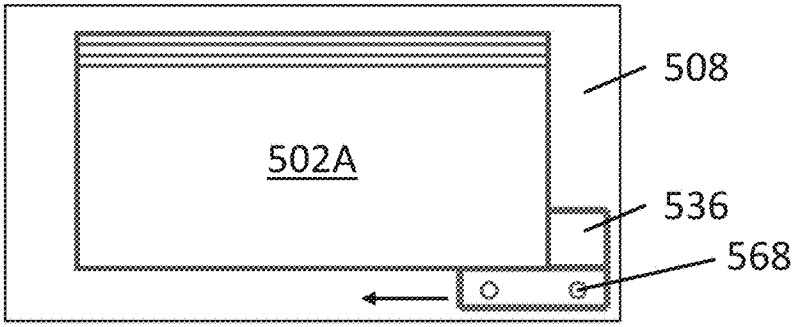
FIG. 5A is a top-down view of an example method of installing a first panel and a second panel with an interlock to a base surface according to an example of the present disclosure.
Figure 5B:
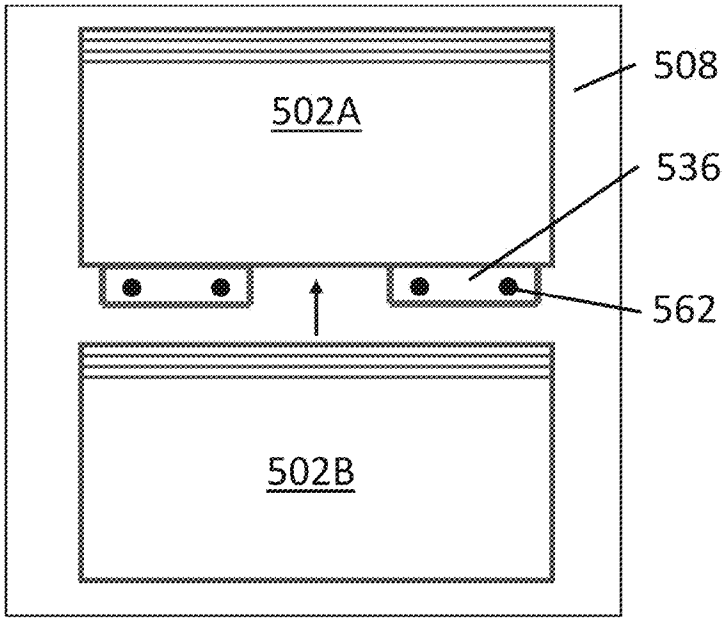
FIG. 5B is a top-down view of another step of an example method of installing a first panel and a second panel with an interlock to a base surface according to an example of the present disclosure.
Figure 5C:
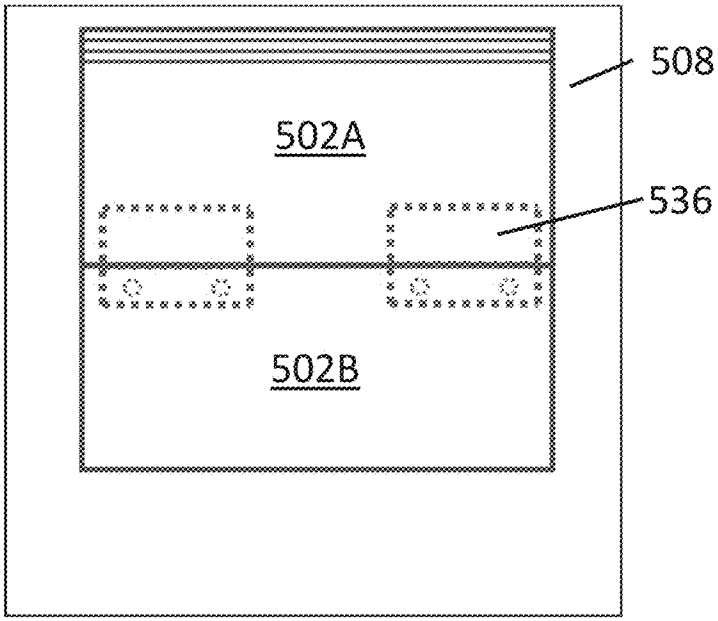
FIG. 5C is a top-down view of another step of an example method of installing a first panel and a second panel with an interlock to a base surface according to an example of the present disclosure.

Moving to FIG. 5A-5C, FIG. 5A-5C are top-down views of an example method of installing a first panel 502A to a second panel 502B with an interlock 536. In FIG. 5A, a first panel 502A is provided with interlock 536 being inserted (e.g. slid) into a side of the first panel 502A and directed to a different side of the first panel 502A. In some examples, the first panel 502A is secured to base surface 508 before interlock 536 is inserted into a side of the first panel 502A. However, in some examples, first panel 502A is not connected to a base surface before interlock 536 is inserted. It can be advantageous to insert interlock 536 into first panel 502A before first panel 502A is secured to the base surface 508 as it can be difficult to insert interlock 536 into first panel 502A if first panel 502 is connected to the base surface 508. For example, inserting interlock 536 into a first panel 502A which is already secured to base surface 508 can require deflection (e.g. bending) of one or both of first panel 502A and interlock 536. Interlock 536 can include one or more openings 568 in which one or more fasteners can be put through to secure interlock 536 to base surface 508. Moving to FIG. 5B, multiple interlocks 536 are inserted into first panel 502A. Further, fasteners 562 are inserted into openings 568 and fastened to base surface 508 such that interlock 536 is secured to base surface 508. Openings 568 can provide a guide for fasteners 562 which can allow for quicker and more precise installation. Openings 568 can be any shape including circles, ellipses, and rounded rectangles which can allow for various positioning of fasteners 562 through the openings 568. In some examples, first panel 502A is connected to base surface 508 prior to fasteners 562 being used to secure interlock 536 to base surface 508. However, in some examples, interlock 536 is secured to the base surface 508 before first panel 502A is secured to the base surface 508. In FIG. 5B, second panel 502B is directed upward toward first panel 502A and toward the peak of the roof. Moving to FIG. 5C, second panel 502B is connected to first panel 502A with interlock 536. One form of connecting second panel 502B to first panel 502A is described with reference to FIG. 6A-6D. As indicated by the dashed lines in FIG. 5C, interlock 536 is not visible when first panel 502A and second panel 502B are connected. This can be advantageous as appearing to have no seams between panels can be aesthetically pleasing.

While two individual interlocks 536 are shown in FIG. 5B, in some examples, fewer or more interlocks can be used. In some examples, a single interlock is used and in some further examples, the single interlock can stretch across the roof substantially the same length as the first and second panels. Various lengths and numbers of interlocks are contemplated.

Figure 6A:
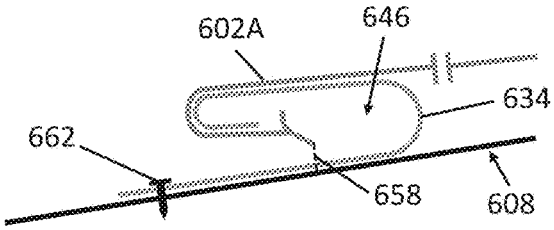
FIG. 6A is a perspective view of an example step of installation of an interlock to a first panel and a base surface according to an aspect of the present disclosure.
Figure 6B:
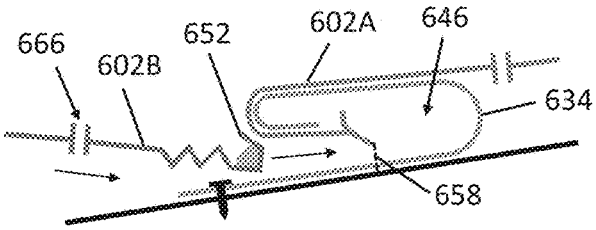
FIG. 6B is a perspective view of an example step of installation of a second panel to a first panel according to an aspect of the present disclosure.
Figure 6C:
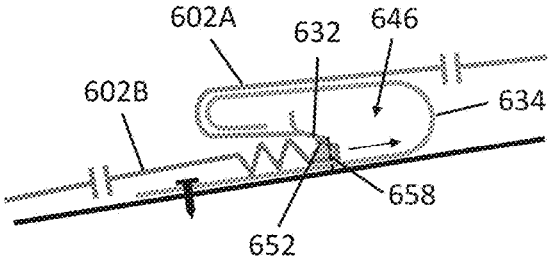
FIG. 6C is a perspective view of another example step of installation of a second panel to a first panel according to an aspect of the present disclosure.
Figure 6D:
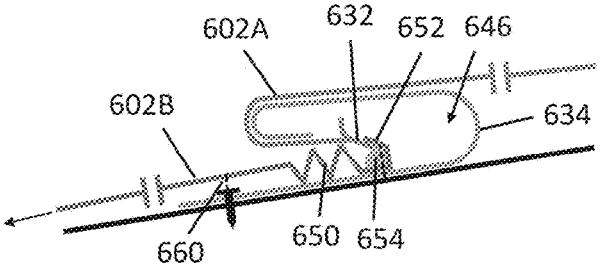
FIG. 6D is a perspective view of another example step of installation of a second panel to a first panel according to an aspect of the present disclosure.

Moving to FIG. 6A-6D, FIG. 6A-6D are perspective views of an example installation of a second panel 602B above base surface 608 with a first panel 602A and an interlock 634 already installed. In the example of FIG. 6A, the interlock 634 is secured to the base surface 608 by fastener 662. Additionally, FIG. 6A includes an entrance 658 to a receiving portion 646 of interlock 534. Moving to FIG. 6B, second panel 602B includes a hook portion 652 at an end of the second panel 602B. Second panel 602B extends further than shown in FIG. 6B as shown by break 666. In installation, second panel 602B can be directed (e.g. inserted) toward receiving portion 646 of interlock 634 and beneath first panel 602A. In FIG. 6C, the hook portion 652 of the second panel 602B engages the second protrusion 632 of first panel 602A and can be deflected (e.g. compressed) by the second protrusion 632 of first panel 602A as it passes through entrance 658. In some examples, the second protrusion 632 is deflected (e.g. compressed). However, in some examples, one or both of the second protrusion 632 and the hook portion 652 are not deflected. Second panel 602B is further directed upward toward the peak of the roof through entrance 658 and into the receiving portion 646 of interlock 634. In FIG. 6D, the hook portion of the 652 of the second panel 602B is uncompressed and connects with the second protrusion 632 of the first panel 602A. Additionally, second protrusion 632 of first panel 602A is in contact with sealant 654 of second panel 602B. Thus, second panel 602B is connected to first panel 602A. The hook portion 652 is within the receiving portion 646 of interlock 634. In some examples, to ensure proper connection between first panel 602A and second panel 602B, second panel 602B is directed toward the eave of the roof. This can cause second protrusion 632 to be further in contact with sealant 654. As shown in FIG. 6D, folded portions 650 of second panel 602B can create a space 660 above fastener 662 which can prevent fastener 662 from contacting the bottom of second panel 602B. Further, folded portion 650 of second panel 602B can lead directly into a sheet-like portion of the second panel 602B.

Figure 7A:
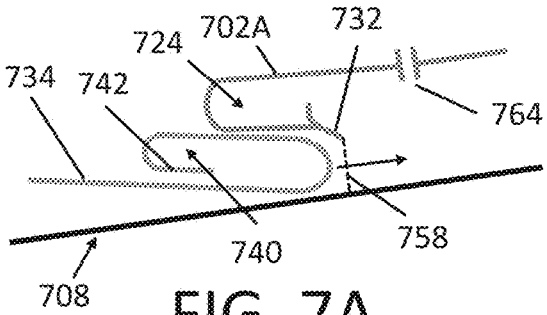
FIG. 7A is a perspective view of an example step of installation of an interlock to a first panel according to an aspect of the present disclosure.
Figure 7B:
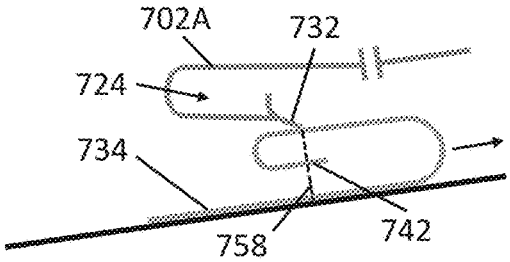
FIG. 7B is a perspective view of another example step of installation of an interlock to a first panel according to an aspect of the present disclosure.
Figure 7C:
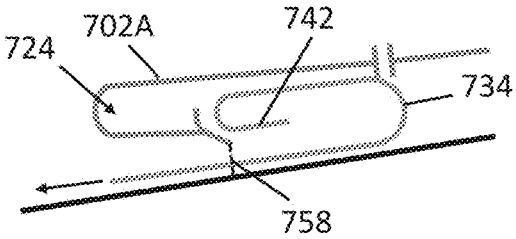
FIG. 7C is a perspective view of another example step of installation of an interlock to a first panel according to an aspect of the present disclosure.
Figure 7D:
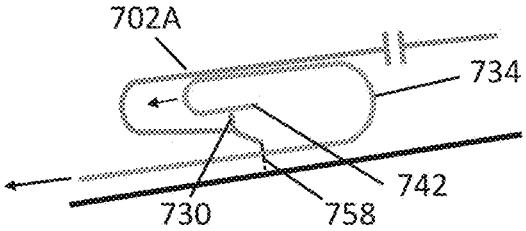
FIG. 7D is a perspective view of another example step of installation of an interlock to a first panel according to an aspect of the present disclosure.
Figure 7E:
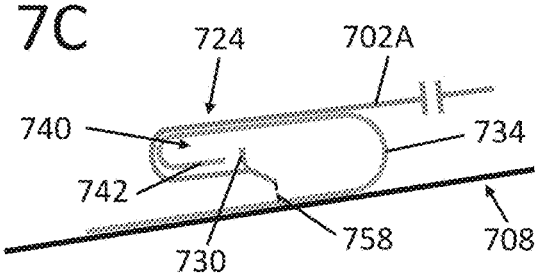
FIG. 7E is a perspective view of another example step of installation of an interlock to a first panel according to an aspect of the present disclosure.

Moving to FIG. 7A-7E, FIG. 7A-7E are perspective views of an example installation of an interlock 734 to a first panel 702A above a base surface 708. Starting with FIG. 7A, a first panel 710A includes a receptacle portion 724 and a second protrusion 732. First panel 702A extends further than what is shown by FIG. 7A and the extension is shown by break 764. In some examples, first panel 702A is secured to the base surface 708 prior to installation of interlock 734 upward of break 764. However, in some examples, first panel 702A is not secured to the base surface prior to installation of interlock 734. Interlock 734 includes a receptacle portion 740 and a hook portion 742. In FIG. 7A, interlock 734 is directed (e.g. inserted) beneath first panel 702A and forward toward a peak of the roof. In FIG. 7B, interlock 734 is partially beneath first panel 702A and is passing through entrance 758. As interlock 734 passes beneath first panel 702A, the interlock 734 and the first panel 702A can engage with each other. During the engagement, in some examples, the receptacle portion 740 and/or hook portion 742 of the interlock 734 can be deflected (e.g. compressed) by first panel 702A. Additionally or alternatively, the receptacle 724 of the first panel 702A can be deflected (e.g. compressed) by interlock 734. In some examples, the end of panel 702A which includes the receptacle portion 724 and second protrusion 732 lifts upward away from base surface 708 such that interlock 734 can be passed underneath the first panel 702A. In some such examples, compression of interlock 734 can be minimized. Moving to FIG. 7C, interlock 734 is beneath first panel 702A and is directed downward toward an eave of the roof so interlock 734 can fully interlock with first panel 702A. Specifically, interlock 734 is directed such that hook portion 742 is directed into receptacle portion 724 of the first panel. In FIG. 7D, the receptacle 724 of first panel 702A is expanded as the interlock 234 is moved past first protrusion 730 of the first panel 702A. Interlock 734 is further directed downward (e.g. toward the eave of the roof) until it reaches the position of FIG. 7E. In FIG. 7E, the hook portion 742 of interlock 734 is in an uncompressed state and receptacle 724 is also in an uncompressed state. In this configuration, receptacle 740 and hook portion 742 of the interlock 734 are located within receptacle 724 of the first panel 702A. Further, hook portion 742 of the interlock 734 is prevented from moving the interlock substantially upward toward the peak of the roof by the first protrusion 730 of the first panel 702A. Thus, interlock 734 is connected with first panel 702A such that they are not easily separated from each other.

The example steps of installing panels on a roof as provided in FIG. 5A-5E, FIGS. 6A-6D, and FIGS. 7A-7C can be repeated with additional panels. In some examples, the steps of installing are repeated in succession for any additional panels. In some examples, a user can secure a first panel to a base surface at a first point using an inserted interlock. Subsequently, the user can secure a second panel to the first panel and secure the second panel to the base surface using an interlock at a second point. In some examples, the second point is below the first point, toward the eaves of a structure. In some examples, the first point, and thus the first panel, is located closer to the upper portion of the roof. In some examples, after securing a second panel to the first panel and the base surface, a third panel can be secured to the second panel using a second interlock at a third point below the first and second points. In such examples, a user can install panels for a roof in a top-down manner; from a peak of a structure to the eaves of the structure. One advantage of installing panels in a top-down manner is that a user can avoid contacting a panel that was previously secured to the base surface. By not contacting the already installed panels, possible damage from said contact can be avoided. For example, a user can avoid stepping on and scratching and/or bending the panels. An additional and/or alternative advantage by installing the panels in a top-down manner is that the installation can take less time than it would take to install the panels in a bottom-to-top fashion. Furthermore, installation can be less complicated than traditional installation of panel roofing as a user only needs to push the second panel under the first panel and above the interlock to secure the second panel to the first panel.

In some examples, a portion of a roofing panel can hang over an edge of the base surface which can be undesirable. In these examples, a user can remove a portion of the panel which hangs over the edge of the base structure. The remaining portion of the panel can then be bent over the edge of the base surface to aid in protecting the base surface from moisture ingress.

In the various examples described, the first panel and the second panel can contain substantially the same structural design and can be interchangeable. For example, the first panel can be swapped with the second panel such that the first panel becomes the second panel and the second panel becomes the first panel. Further panels can be similarly attached to the first panel and the second panel as well as to the base surface. In some examples, the first and second panels as well as the further panels can cover an entire structure, thereby creating a roof which can protect an underlying structure from weather and in particular, ingress of water.

Various examples have been described. These and other examples are within the scope of the following numbered embodiments.

The invention claimed is:

1. An interlocking panel system for covering a surface comprising:

a first panel comprising:

a sheet-like section configured to cover a portion of the surface, a receptacle located at an end of the first panel, the receptacle forming an opening, the sheet-like section connected to and extending away from the receptacle, an interlock comprising:

an interlock hook portion and an interlock receiver, the interlock hook portion configured to be non-reversibly insertable into the first panel receptacle to secure the first panel to the interlock; and a second panel comprising:

a second panel hook portion located at an end of the second panel; and a sheet-like section configured to cover a portion of the surface, the sheet-like section connected to and extending away from the second panel hook portion, the second panel hook portion configured to be insertable into the interlock receiver to secure the second panel to the interlock; wherein the interlock is completely covered by the first panel and the second panel, when the interlock is secured to the first panel and the second panel, such that the interlock is not visible from a top-down view towards the surface.

2. The system of claim 1, wherein the first panel spans a first width, the second panel spans a second width, and the interlock spans a third width, the third width being substantially smaller than either the first width or the second width.

3. The system of claim 1, wherein the first panel and the second panel are made from a material having a first thickness and the interlock is made from a material having a second thickness.

4. The system of claim 1, wherein the first panel further comprises a first panel hook portion located at an end of the first panel opposite the end including the receptacle.

5. The system of claim 1, wherein:

the first panel includes a projection extending toward the surface being covered;

the interlock hook portion is configured to engage with the projection of the first panel when the interlock is inserted into the receptacle of the first panel; and at least one of the interlock hook portion or the receptacle deflecting during the engagement therebetween.

6. An interlocking panel system for covering a surface comprising:

a first panel comprising:

a sheet-like section configured to cover a portion of the surface, a receptacle located at an end of the first panel, the receptacle forming an opening, the sheet-like section connected to and extending away from the receptacle, an interlock comprising:

an interlock hook portion and an interlock receiver, the interlock hook portion configured to be non-reversibly insertable into the first panel receptacle to secure the first panel to the interlock; and a second panel comprising:

a second panel hook portion located at an end of the second panel; and a sheet-like section configured to cover a portion of the surface, the sheet-like section connected to and extending away from the second panel hook portion, the second panel hook portion configured to be insertable into the interlock receiver to secure the second panel to the interlock; and a fastener configured to secure the interlock to the surface, the first panel and the second panel, when the interlock is secured to the first panel and the second panel, being secured to the surface indirectly via the interlock when the faster secures the interlock to the surface.

7. The system of claim 6, wherein the second panel further comprises a lifted section, the lifted section configured to provide a space above the fastener of the interlock.

8. The system of claim 6, wherein the first panel and the second panel each comprise a single sheet of rigid material, the rigid material being a metal.

9. The system of claim 6, further comprising a sealant located within the second panel hook portion.

10. The system of claim 6, wherein the first panel further comprises a first projection extending toward the inner face and a second projection extending away from the inner face, the interlock hook portion being further configured to engage with the first projection during insertion with at least one of the interlock hook portion or the receptacle deflecting during the engagement therebetween.

11. A method of installing an interlocking panel system on a surface comprising:

securing an interlock to a first panel, the first panel comprising a receptacle located at an end of the first panel, the securing the interlock to the first panel including non-reversibly inserting an interlock hook portion into the receptacle of the first panel such that the interlock hook portion engages the first panel;

securing the interlock to the surface, the interlock comprising a receiving portion; and securing a second panel to the first panel by inserting a second panel hook portion into the interlock receiving portion between the first panel and the interlock such that the second panel hook portion engages a portion of the first panel.

12. The method of claim 11, wherein the interlock is secured to the surface with a fastener.

13. The method of claim 12, wherein the first panel and the second panel are not directly secured to the surface.

14. The method of claim 13, wherein the first panel and the second panel are secured to the surface via the interlock.

15. The method of claim 11, wherein securing the second panel to the first panel obscures the interlock from view.

16. The method of claim 11, further comprising:

securing a second interlock to the second panel, the second panel comprising a second receptacle located at an end of the second panel opposite the second panel hook portion, the securing the second interlock to the second panel including inserting a second interlock hook portion into the receptacle of the second panel such that the second interlock hook portion engages the second panel;

securing the second interlock to the surface, the second interlock comprising a second receiving portion; and securing the third panel to the second panel by inserting a third panel hook portion into the second interlock receiving portion between the second panel and the second interlock such that the third panel hook portion engages a portion of the second panel.

17. The method of claim 11, wherein the surface is a sloped roof, the method further comprising securing an end of the first panel, opposite the end including the receptacle, to the sloped roof at a first point.

18. The method of claim 17, wherein the interlock is secured to the sloped roof at a second point below the first point.

19. The method of claim 17, wherein the end of the first panel opposite the end including the receptacle is secured to the sloped roof directly.

20. The method of claim 11, wherein securing the interlock to the first panel comprises inserting the interlock hook portion into the receptacle of the first panel from an edge of the first panel.

* * * * *